US006591448B1

(12) United States Patent
Eklund et al.

(10) Patent No.: US 6,591,448 B1
(45) Date of Patent: Jul. 15, 2003

(54) CARPET EXTRACTION MACHINE RECOVERY TOOL

(75) Inventors: William R. Eklund, Springdale, AR (US); Trent A. Fulghum, Fayetteville, AR (US)

(73) Assignee: Alto US Inc., Chesterfield, MO (US)

( * ) Notice: Subject to any disclaimer, the term of this patent is extended or adjusted under 35 U.S.C. 154(b) by 0 days.

(21) Appl. No.: 09/716,310

(22) Filed: Nov. 20, 2000

(51) Int. Cl.[7] ..... A47L 9/02
(52) U.S. Cl. ..... 15/401; 15/371
(58) Field of Search ..... 15/401, 371, 245

(56) References Cited

U.S. PATENT DOCUMENTS

| | | | | | |
|---|---|---|---|---|---|
| 965,315 | A | * | 7/1910 | Moorhead | 15/143.1 |
| 2,516,246 | A | * | 7/1950 | Norris | 15/320 |
| 2,677,144 | A | | 5/1954 | Parry | |
| 2,842,789 | A | * | 7/1958 | Wells | 15/117 |
| 3,107,387 | A | * | 10/1963 | Katt | 15/375 |
| 3,324,499 | A | * | 6/1967 | West | 15/322 |
| 3,605,171 | A | | 9/1971 | Candor et al. | |
| 3,780,398 | A | | 12/1973 | Candor | |
| 4,190,924 | A | | 3/1980 | Nicholson | |
| 4,520,528 | A | | 6/1985 | Grof | |
| 4,817,233 | A | | 4/1989 | Waldhauser | |
| 5,101,534 | A | * | 4/1992 | Watanabe et al. | 15/377 |
| 5,349,722 | A | | 9/1994 | Chayer | |
| 5,377,382 | A | | 1/1995 | Bores et al. | |
| 5,388,305 | A | | 2/1995 | Fields | |
| 5,918,346 | A | | 7/1999 | Suzuki | |
| 5,933,911 | A | | 8/1999 | Windmeisser | |
| 6,047,437 | A | * | 4/2000 | Suzuki | 15/245 |

* cited by examiner

*Primary Examiner*—Terrence R. Till
(74) *Attorney, Agent, or Firm*—Blackwell Sanders Peper Martin LLP

(57) ABSTRACT

A recovery system for use in a floor cleaning machine of the type including a dispensing system and a recovery system. The dispensing system configured for dispensing a liquid cleaning solution onto a floor surface to facilitate the removal of dirt from the floor surface. A recovery system configured for recovering cleaning solution and dirt from the floor surface thereby leaving a cleaned floor surface. The recovery system comprises a recovery tool movable over the floor surface. The recovery tool comprises a body including an interior suction chamber in fluid communication with a source of vacuum. At least one blade is secured to the tool body and depending therefrom for engagement with the floor surface to provide fluid communication between the suction chamber and the floor surface, whereby cleaning solution and dirt are suctioned from the floor surface. The blade is substantially rigid to inhibit deformation of the blade during operation of the floor cleaning machine and is movable relative to the tool body such that the blade remains substantially in engagement with the floor surface while moving relative to the tool body to adapt to contours in the floor surface.

20 Claims, 5 Drawing Sheets

CARPET EXTRACTION MACHINE RECOVERY TOOL

BACKGROUND OF THE INVENTION

This invention relates generally to an extraction machine used for cleaning floor surfaces with a cleaning liquid and then extracting the liquid from the floor, and more particularly to such an extraction machine comprising an improved cleaning liquid recovery tool.

In extraction machines of conventional design as shown in FIG. 1, a solution tank contained within the machine housing dispenses a liquid cleaning solution onto the floor surface to be cleaned, such as a carpet. The cleaning solution is typically a premixed solution comprised of water and a liquid or powder cleaning agent. One or more spray nozzles of the extraction machine spray cleaning solution onto the carpet. The scrub brush, rotatably driven by a brush motor, then works the cleaning solution into the carpet to lift dirt from the carpet, temporarily leaving a dirty solution within the carpet.

The machine is self-propelled or moved manually to pass over the dirty solution so that a vacuum tool mounted on the machine moves over the portion of the carpet worked by the scrub brush. The vacuum tool comprises a hollow body with two elongate blades extending from the bottom of the body in spaced, generally parallel relationship, so that each blade forms a rough seal with the carpet (FIG. 2). The vacuum tool provides a vacuum within a suction chamber, above the surface of the carpet, allowing the extraction of dirt and solution from the carpet. A vacuum pump driven by a vacuum motor creates a vacuum within a recovery tank, which communicates with the tool by means of a recovery line extending between the recovery tank and the tool. Suction created by the vacuum pump extracts the dirty cleaning solution from the carpet, resulting in a cleaned carpet. Dirty solution passes through the tool and recovery line into the recovery tank carried by the machine.

Conventional vacuum tool blades are formed from unitary pieces of hard material such as plastic. One disadvantage of using such a design is that when the blades encounter an uneven portion of the carpet, the blades lift from flatwise engagement with the carpet, creating air gaps and breaking the seal between the blades and the carpet. These air gaps degrade the effectiveness of the vacuum because they allow air to enter the suction chamber without extracting any dirty cleaning solution from the carpet. This increases how much cleaning solution residue remains in the carpet after cleaning, resulting in quicker resoiling of the carpet and longer drying time after cleaning. Another drawback of the conventional tool described above is the potential for damaging the tool should it strike a door threshold or other hard object. Damaging the recovery tool often further degrades the vacuum, exacerbating vacuum losses. Finally, a damaged vacuum blade on a conventional extraction machine requires replacing the entire blade, which is not cost effective when only a portion is damaged.

SUMMARY OF THE INVENTION

Among the several objects and features of an extraction machine of the present invention may be noted the provision of a recovery system that maintains a tight seal with the floor surface being cleaned over uneven portions of the floor surface; the provision of such a recovery system that improves the strength and effectiveness of the vacuum created beneath the tool; the provision of such a recovery system that more effectively removes dirty cleaning solution from a cleaning surface; the provision of such a recovery system that reduces the drying time of the floor surface; the provision of such a recovery system that reduces the likelihood of damage to the system when encountering door thresholds or other objects; the provision of such a recovery system that allows for easy replacement of damaged or worn system parts, including blade holders, blades and related parts; and the provision of an improved blade assembly and replacement blades therefor.

Generally, a recovery system of the present invention comprises a recovery tool movable over a floor surface. The tool has a body including an interior suction chamber in fluid communication with a source of vacuum. At least one elongate blade assembly is secured to the tool body and comprises a blade engageable with the floor surface to provide a seal between the blade and the floor surface. Cleaning solution and dirt are suctioned from the floor surface by the source of vacuum. The blade is substantially rigid to inhibit deformation of the blade during operation of the floor cleaning machine and is movable relative to the tool body such that the blade remains substantially in engagement with the floor surface while moving relative to the tool body to adapt to contours in the floor surface.

In a second embodiment of the present invention, a recovery system comprises a recovery tool comprising a blade generally as set forth above. The blade mounts resiliently on the tool for floating movement relative to the tool body so that the blade remains substantially in engagement with the floor surface while moving relative to the tool body to adapt to floor surface contours.

In a third embodiment of the present invention, a recovery system comprises a recovery tool comprising a blade generally as set forth above. The blade further comprises a plurality of blade segments independently secured to and resiliently mounted on the tool for floating movement of the individual segments with respect to the body and each other, further enabling the segments to conform to uneven floor surfaces.

The present invention is also directed to a blade assembly for use in a floor cleaning machine of the type including a dispensing system configured for dispensing a liquid cleaning solution onto a floor surface to facilitate the removal of dirt from the floor surface and a recovery system configured for recovering cleaning solution and dirt from the floor surface thereby leaving a cleaned floor surface. The blade assembly comprises an elongate blade having an upper portion and a floor engaging lower portion, and a holder for holding the blade for movement of the blade between an extended position and a retracted position. The assembly also includes a spring system mounted on the holder and engageable with the upper portion of the blade for biasing the blade to an extended position. Movement of the blade over an uneven contour of the floor surface moves the blade from the extended position upwardly toward a retracted position against the bias of the spring system to accommodate the uneven contour while maintaining a sealing engagement between the floor surface and the blade.

Another aspect of the present invention is directed to a blade which can be used on a floor cleaning machine of the type described above. The blade has an upper portion adapted to be held by a blade holder of the machine, and a lower portion engageable with the floor surface to be cleaned. The upper portion of the blade has an upward facing surface configured for engagement by a spring system on the blade holder to bias the blade in a downward direction toward the floor surface. The upper portion also has a downward facing surface engageable with the blade holder for limiting the downward movement of blade toward a floor surface.

The present invention is also directed to a cleaning machine comprising a recovery tool generally as set forth above. The cleaning machine is of the type comprising a main housing and at least one spray nozzle mounted on the main housing for spraying a cleaning solution onto a floor surface. The machine comprises a brush housing mounted on the main housing that includes at least one scrub brush for agitating a floor surface.

Other objects and features will become in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
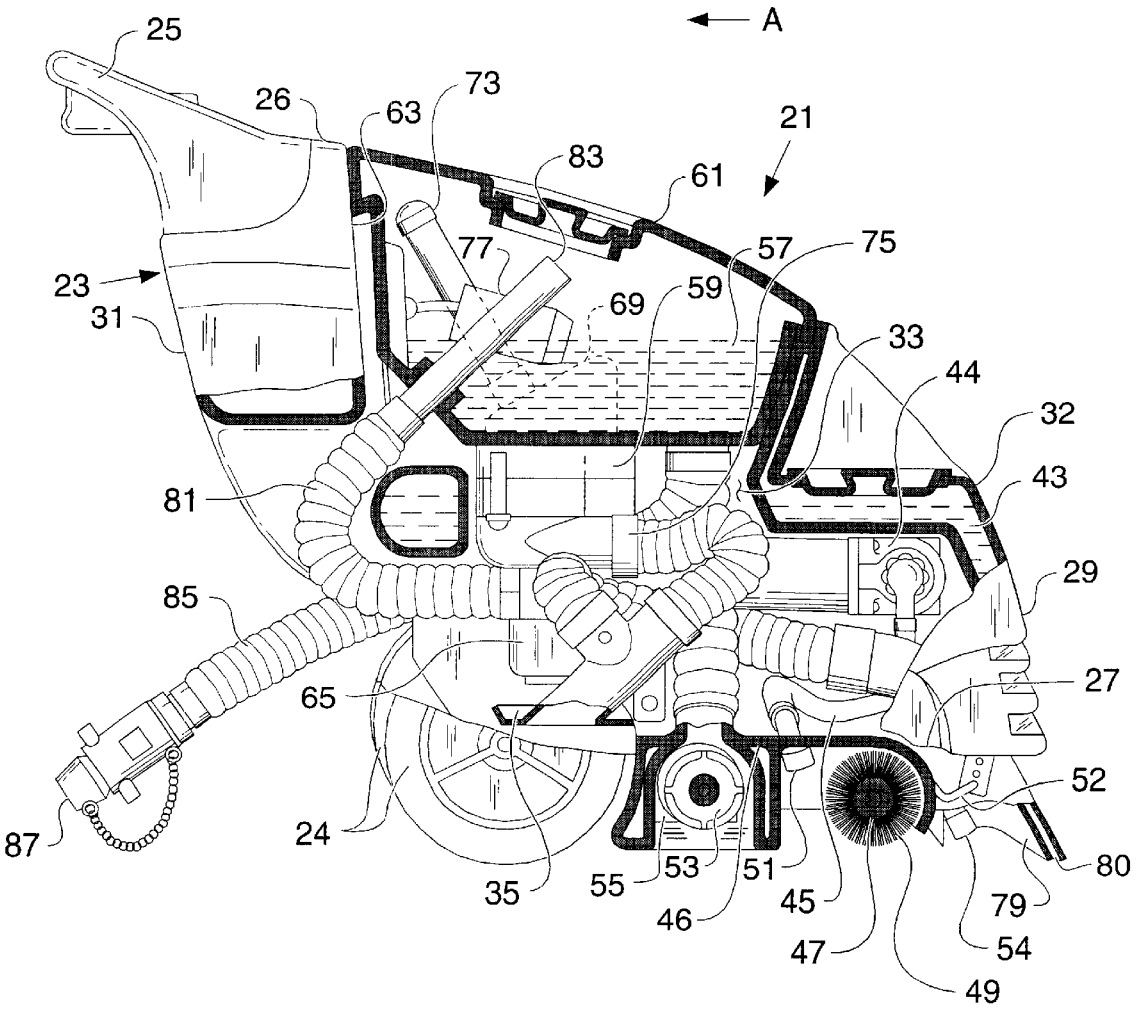
Fig. 1. ( PRIOR ART )
FIG. 1 is a side elevation and partial section of a prior art extraction machine as may be conveniently used with the present invention.

Referring now to FIG. 1, a conventional extraction machine for cleaning floor surfaces, such as carpeting, is indicated in its entirety by the reference numeral 21. The extraction machine 21 comprises a main housing, indicated generally at 23, mounted on wheels 24 so an operator can readily move the machine. A motor (not shown) may also drive the wheels 24 to self-propel the extraction machine 21. A handle 25 mounted at the rear of the machine 21 gives the operator a convenient means for guiding and maneuvering the extraction machine during operation. Suitable controls (not shown) on the handle 25 control various operating components of the machine 21. The operator pulls the handle 25 to move the machine 21 in a rearward direction, indicated by arrow A.

The main housing 23 has a top wall 26, a bottom wall 27, a front wall 29, a rear wall 31 and side walls (not shown), portions of which define a solution tank 32. The main housing 23 also defines a cavity 33 that contains the operating components of the extraction machine 21. Plates 35 partially define the bottom wall 27 of the main housing 23 (one such plate being shown in FIG. 1). The plates 35 are spaced apart in close relationship with each other to define air gaps (not shown) between the plates. These gaps allow ambient air external to the main housing 23 to enter the cavity 33.

The solution tank 32 holds a supply of liquid cleaning solution 43 for cleaning the carpet. A solution pump 44 communicates with the solution tank 32 to deliver cleaning solution 43 from the tank to a feed line 45. A brush housing 46 mounts on the underside of the main housing 23. A locator pin 52 releasably secures the brush housing 46 at a predetermined height above the carpet. The operator may adjust the height of the brush housing 46 according to the depth of the carpet to be cleaned. The feed line 45 extends through the brush housing 46 to a manifold (not shown) to direct cleaning solution 43 to one or more spray nozzles 51 spaced laterally across the bottom of the brush housing for delivering cleaning solution onto the surface to be cleaned. A second set of nozzles 54 placed beneath the front of the main housing 23 directs additional cleaning solution 43 onto the surface to be cleaned.

A rotary scrub brush 47 mounted for rotation within the brush housing 46 has bristles 49 which contact the surface to be cleaned. The scrub brush 47 is near the spray nozzles 51 to encourage interaction between the scrub brush and the cleaning solution 43. The scrub brush 47 is driven by a brush motor 53 located in a compartment 55 in the brush housing 46 to effect a scrubbing action with the cleaning solution to remove dirt within the carpet. As dirt is removed from the surface, it clings to the cleaning solution, leaving dirty solution on the surface of the carpet. The second set of nozzles 54 dispenses additional cleaning solution onto the surface after the brush 47 passes over a particular portion of the surface to further attract dirt before suctioning of the dirty solution from the surface.

A vacuum pump 59 is mounted within the cavity 33 directly below a solution recovery tank 61 seated in an opening 63 in the top wall 26 of the housing 23. A vacuum motor 65, such as an electric drive motor, mounted beneath the vacuum pump 59 drives the pump and an associated suction fan (not shown). The vacuum pump 59 has an intake (not shown) which communicates with the inside of a hollow air cap 69 sealingly attached to or integrally formed with the bottom wall of the recovery tank. A suction pipe 73 extends up from this cap 69 to a location adjacent the top of the recovery tank 61. Operation of the vacuum pump 59 and associated suction fan draws air from the recovery tank 61 to create a vacuum in the tank. The vacuum pump 59 has an exhaust 75 for exhausting air from the suction fan. A liquid level sensor 77 senses the level of dirty solution 57 within the recovery tank 61. This sensor 77 is operable to shut off the extraction machine 21 before the solution level reaches the upper end of the suction pipe 73.

A recovery tool 79 mounts on the underside of the main housing 23 and extends between the housing and the carpet so that the tool and wheels 24 combine to support the extraction machine 21 in an upright position. The tool 79 has a centrally located opening 80 extending upwardly therethrough. This opening 80 is connected by means of a flexible recovery line or hose 81 to a rigid fill tube 83 extending up into the recovery tank 61, the upper end of the tube being at a level higher than that of the level sensor 77. As the tool 79 passes over the surface being cleaned, the vacuum in the recovery tank 61 is sufficient to extract dirty solution 57 from the carpet through the opening 80 in the tool and up through the hose 81 and the fill tube 83 for delivery to the recovery tank 61. A drain line 85 with a closure 87 drains dirty solution 57 from the recovery tank 61 as needed.

Figure 2:
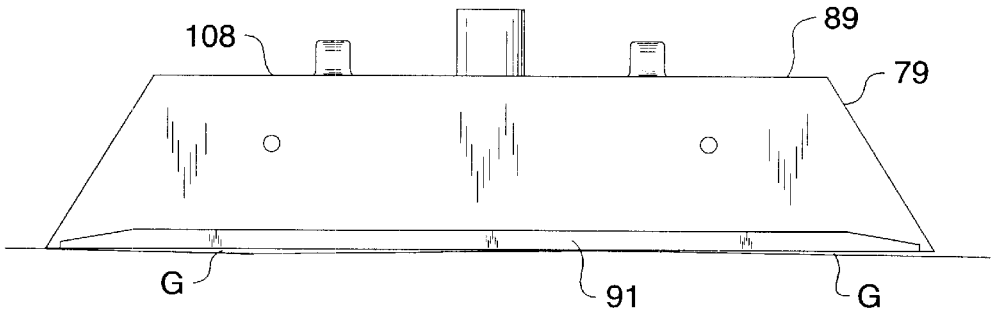
Fig. 2. ( PRIOR ART )
FIG. 2 is a front elevation of a recovery tool of the carpet cleaning machine of FIG. 1.

With reference to FIG. 2, the tool body 89 of the conventional extraction machine recovery tool 79 is generally elongate in shape, with a pair of straight, rigid blades 91 mounted beneath the body in parallel spaced-apart relationship. The blades 91 are intended to engage and form a rough seal with the carpet, so that the vacuum in the recovery tank 61 creates a vacuum between the blades for extracting dirty solution 57 from the carpet. However, the rigidity of the blades 91 can hamper performance of the machine 21 as the blades pass over the ridges and valleys in the carpet. As shown in FIG. 2, a carpet ridge can lift the tool 79 from the carpet, creating air gaps G between the blades 91 and carpet. The gaps G allow outside air to pass freely beneath the blade 91 (instead of being forced through the carpet), thus lessening the effectiveness of the vacuum and slowing dirty solution removal.

Figure 3:
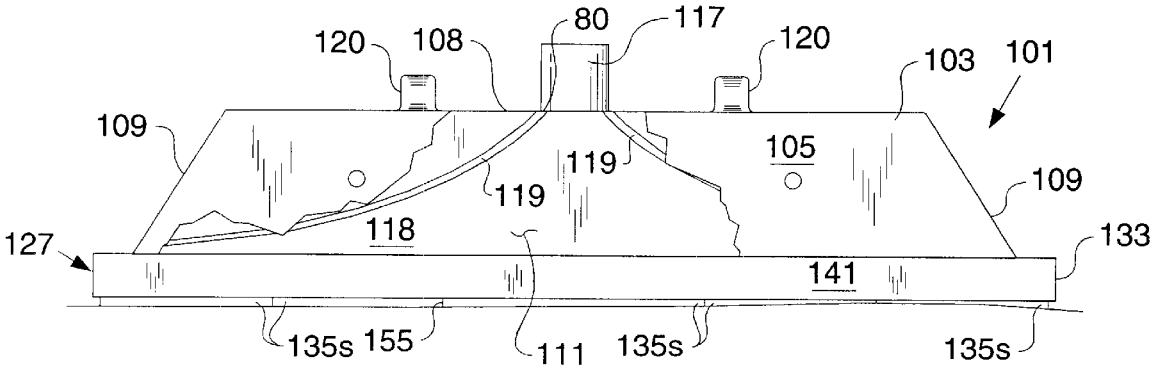
FIG. 3 is a front elevation of a recovery tool of the present invention, with a portion broken away to reveal internal construction.
Figure 4:
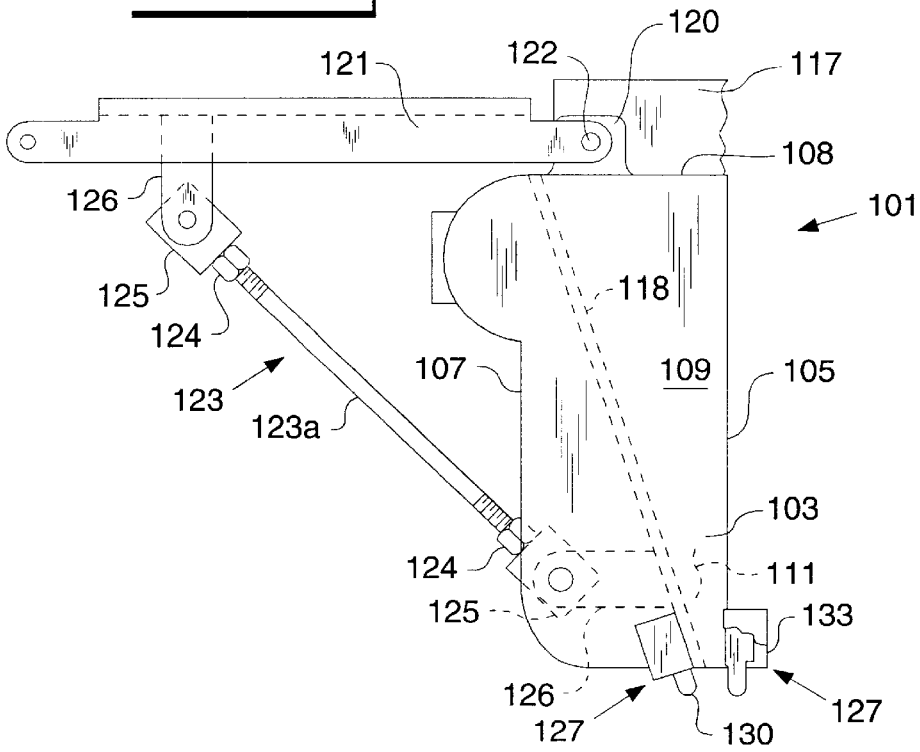
FIG. 4 is a side elevation of the recovery tool of FIG. 3, with a portion broken away to reveal internal construction.

Referring now to FIGS. 3 and 4, a recovery tool of the present invention for extracting cleaning solution from a floor surface, such as a carpet, is indicated in its entirety by reference numeral 101. The recovery tool 101 is shown and described herein in connection with an extraction machine, such as the conventional extraction machine 21 illustrated in FIGS. 1 and 2. The recovery tool 101 comprises a hollow tool body 103 defined by a front wall 105, a rear wall 107, a top wall 108 and two end walls 109 sloping laterally outward from the top wall to the respective bottoms of the front and rear walls. The bottom of the tool body 103 is open, and the tool body is movable over the floor surface for engaging the floor surface and suctioning cleaning solution and dirt. The opening 80 in the top wall 108 of the tool body 103 connects to a hose seat 117 and to the flexible hose 81 for fluid communication with the recovery tank 61. The hollow tool body 103 further comprises a suction chamber 11 (FIG. 4) defined by an interior panel 118, shown in dashed (hidden) lines in FIG. 4, opposing partitions 119 (FIG. 3) and the front wall 105. The suction chamber 111 is additionally in fluid communication with the source of vacuum. The interior panel 118 extends laterally between the end walls 109 and slopes up from the bottom of the tool body at an angle toward the top wall 108, the opening 80 in the top wall being disposed intermediate the interior panel and the front wall 105. Opposing partitions 119 extend between the interior panel 118 and the front wall 105 of the tool body 103. The suction chamber 111 suctions dirty solution from the floor surface into the recovery tool 101.

In the illustrated embodiment, the interior panel 118 slopes upward and rearward from the bottom of the tool body 103 to the top wall 108. However, the interior panel 118 may be oriented otherwise without departing from the scope of this invention. As illustrated, the partitions 119 are generally arcuate, curving from the end walls 109 up toward the opening 80 for directing dirty solution 57 in the suction chamber 111 to flow up through the opening 80 to the recovery tank 61. However, it is contemplated that the partitions 119 may be other than arcuate, such as straight, or may be omitted, without departing from the scope of this invention. The surfaces of the front wall 105, interior panel 118 and partitions 119 defining the suction chamber 111 are smooth to promote flow of the dirty cleaning solution 57 up to the opening 80.

The recovery tool 101 is suspended from the extraction machine 21 for engagement with the floor surface. Two attachment ears 120 extend from the top wall 108 of the recovery tool 101 (FIGS. 3 and 4). The attachment ears 120 are engageable with a horizontal support bracket 121 through pin connections 122. The bracket 121 is mounted on the extraction machine 21, allowing the recovery tool 101 to pivot relative to the bracket about the pin connections 122. During use, the recovery tool 101 is preferably oriented in a vertical position as depicted in FIG. 4. To orient and hold the recovery tool 101 in a substantially vertical position, a positioning turnbuckle is generally indicated at 123. The turnbuckle 123 includes a rotatable adjustment shaft 123*a*, two locknuts 124 threadably connected to the shaft and two ball joints 125 threadably connected to the shaft. The ball joints 125 pivotably mount on flanges 126 extending from the recovery tool 101 and the bracket 121. To alter the length of the turnbuckle 123, both locknuts 124 must be rotated about the adjustment shaft 123*a* so that they move away from the ball joints 125, unlocking the adjustment shaft so that it may freely rotate. The ends of the adjustment shaft 123*a* are oppositely threaded, so that rotating the shaft in one direction pulls both ball joints 125 inward, shortening the turnbuckle 123, while rotating the shaft in the other direction pushes both ball joints outward, lengthening the turnbuckle. The locknuts 124 may then be rotated about the adjustment shaft 123*a* to seat against the ball joints 125, holding the adjustment shaft in a specific orientation and setting the turnbuckle 123 length. As the turnbuckle 123 length changes through the previous steps, the orientation of the recovery tool 101 changes with respect to the bracket 121.

The recovery tool 101 further comprises a pair of longitudinally extending, elongate blade assemblies, each generally designated 127, secured to the bottom of the tool body 103 and depending therefrom in spaced, generally parallel relationship with each other to define a suction inlet 129 (FIG. 5) at the bottom of the recovery tool 101 for extracting dirty solution from the floor surface into the suction chamber 111. In the illustrated embodiment, the blade assemblies 127 are further defined as leading blade assembly 127L and trailing blade assembly 127T. The leading blade assembly 127L angles slightly from vertical while the trailing blade assembly 127T is oriented vertically. However, either assembly 127 may be oriented vertically or at an angle while remaining within the scope of this invention.

Figure 5:
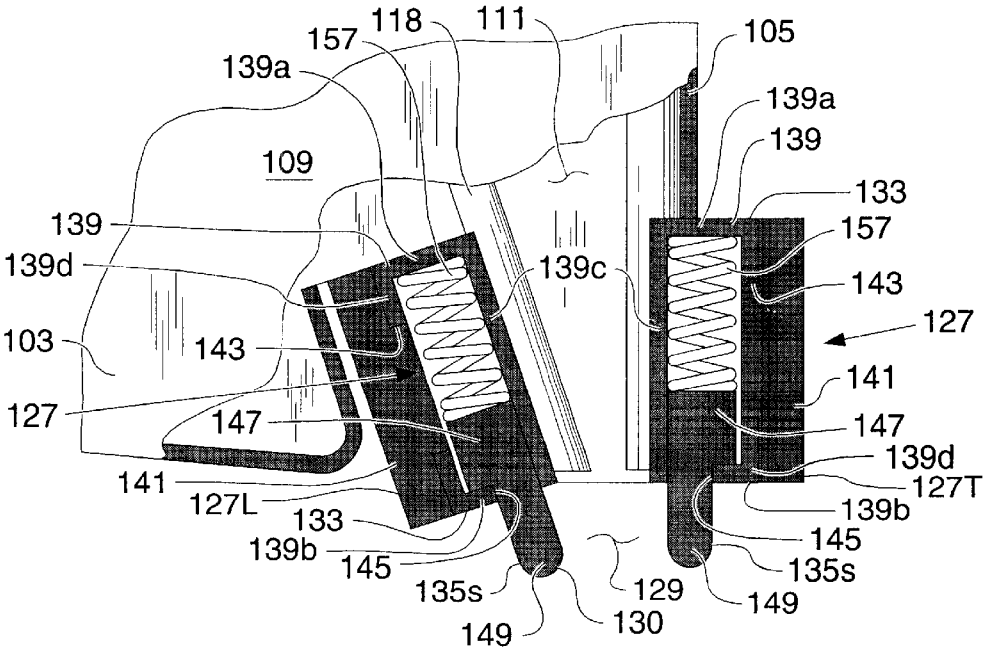
FIG. 5 is a fragmentary, side elevation of the recovery tool of FIG. 3 with a portion broken away to reveal internal construction shown in partial section.
Figure 5A:
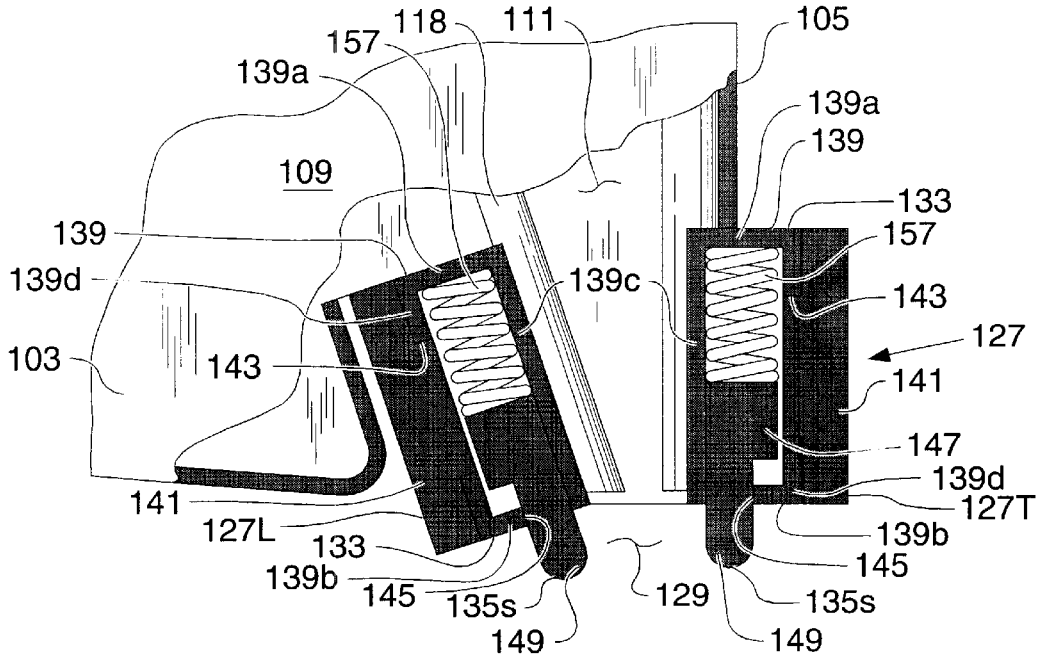
FIG. 5A is a second view of the recovery tool of FIG. 5 with a blade segment in a retracted position.
Figure 6:
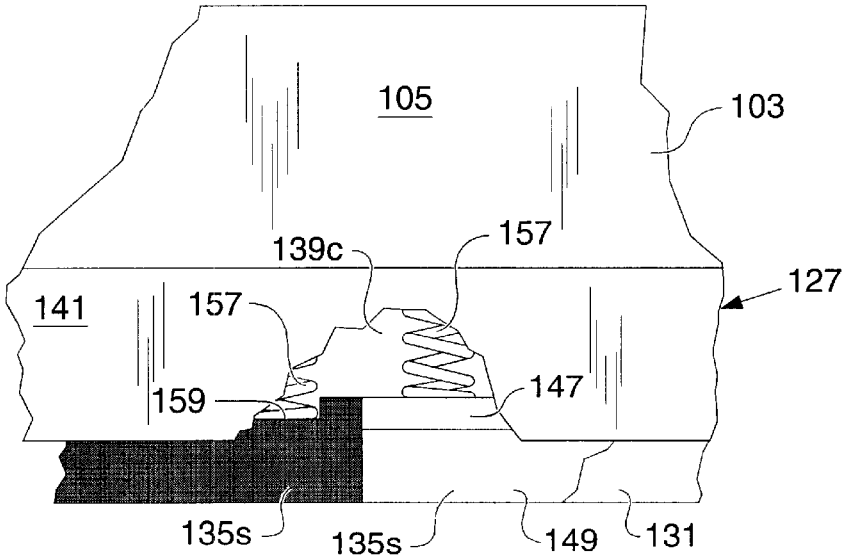
FIG. 6 is a fragmentary, front elevation and partial section of the recovery tool of FIG. 3 with a portion broken away to reveal internal construction.

Each blade assembly 127 comprises an elongate blade holder 133 secured to the tool body 103 along the length of the tool body. As described further below, each blade holder 133 is adapted for holding a blade 135 comprising multiple individual blade segments 135*s* in engagement with the floor surface being cleaned. Six blade segments 135*s* are illustrated in FIG. 3. However, any number of blade segments 135*s*, including a single blade segment, is contemplated as within the scope of this invention. Referring to FIGS. 5, 5A and 6, each blade holder 133 comprises an elongate hollow housing formed by a C-shaped channel member 139 having a top wall 139*a*, a bottom wall 139*b*, a rear side wall 139*c* and a front side wall 139*d*. A removable cover 141 is positioned over an opening 143 in the front side wall 139*d* of the channel member for closing the opening. The cover 141 of the illustrated embodiment is removable for maintaining or replacing blade segments 135*s*. A slot 145 extends longitudinally within the bottom wall 139*b* of the channel member 139 for purposes that will become apparent. In the preferred embodiment, suitable fastening methods mount the blade holders 133 to the tool body. Alternatively, the blade holders 133 may be integrally formed with the tool body.

The blade segments 135*s* seat within a respective blade holder 133 in end-to-end generally abutting relationship with each other, such that the ends of adjacent blade segments abut one another with no significant gaps between the segments. As shown in FIG. 5, the blade segments 135*s* are generally rectangular in cross-section, each including an upper portion 147 sized larger than the width of the slot 145 in the bottom wall 139*b* of the channel member 139 to inhibit the segment from falling out of the blade holder 133, and a lower portion 149 sized to extend down through the slot in the channel member for positive engagement with the floor surface being cleaned. The blade segments 135*s* are preferably constructed from a hard, plastic material or other suitably rigid materials exhibiting good wear resistance properties to inhibit deformation and wearing of the blade segments as the segments engage the floor surface during operation. One particularly preferred material from which the blade segments 135*s* are constructed is Glass Filled Nylon.

Figure 8:
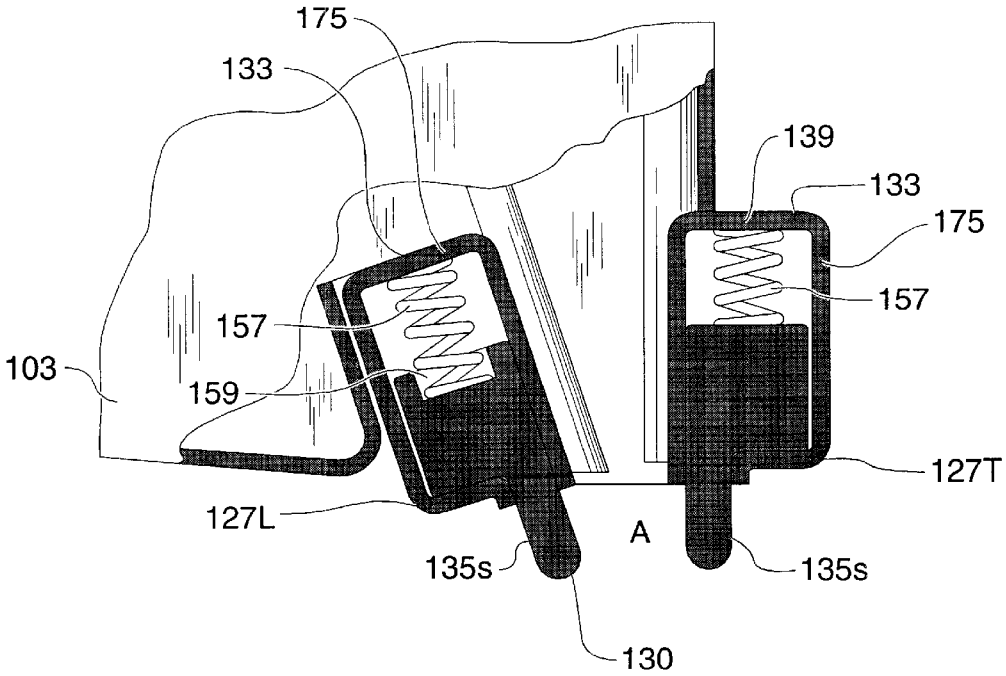
FIG. 8 is a fragmentary, side elevation and partial section with a portion broken away to reveal internal construction of yet another embodiment of the recovery tool of the present invention.

Referring again to FIG. 5, each blade segment 135*s* is independently secured to and resiliently mounted in the blade holder 133 for floating movement relative to the holder, the tool body 103 and the other segments of the same blade 135. Each blade segment is movable between an extended position (FIG. 5) in which the upper portion 147 of the segment seats against the bottom wall 139*b* of the channel member 139 of the blade holder 133, and a retracted position (FIG. 5A) in which the blade segment is pushed up further into the channel member. The blade segments 135*s* are biased toward their extended position by coil compression springs 157 (broadly, a spring member) disposed in the channel member 139 between the upper portion 147 of the blade segments and the top wall 139*a* of the channel member. In the illustrated embodiment of FIGS. 3–6, the springs 157 seat against the top wall 139*a* of the channel member 139. It is contemplated, however, that the springs 157 may seat within indents or recesses 159 in the upper portions 147 of the blade segments 135*s*, as shown in FIGS. 6 and 8 and discussed later herein. Alternately, the springs may fit over spring seats, such as posts (not shown), extending up from the upper portions 147 of the blade segments, for more positive positioning of the springs in the blade holder 133. Springs 157 can take forms other than coil compression springs.

In operation, an extraction machine 21 incorporating the recovery tool 101 of the present invention is operated to move over a floor surface, such as carpeting, along a desired cleaning path. As the extraction machine 21 passes over a section of carpet being cleaned, it applies cleaning solution 43 to the carpet. The brush 47 then works the cleaning solution 43 into the carpet, loosening dirt particles that become suspended in the cleaning solution. As the machine 21 is moved further rearward in the direction of cleaning, it applies additional cleaning solution 43 to the carpet to ensure that the dirt particles are suspended within the solution, forming a dirty solution. Finally, the recovery tool 101 of the present invention passes over the portion of the carpet being cleaned. The vacuum pump 59 creates a vacuum within the recovery tank 61, thereby providing a vacuum in the suction chamber 111 of the tool body 103 of the recovery tool 101. As the recovery tool 101 passes over the carpet, the blade segments 135*s* are biased to their extended position to press down against the carpet to form a rough seal between the blade 135 and the carpet beneath the suction chamber 111. Dirty solution is then suctioned from the carpet up into the tool body 103 and directed by the partitions 119 of the tool body to flow up through the opening 80 in the top wall 108 of the tool body for flowing to the recovery tank 61.

When the recovery tool 101 passes over a section of carpet having a ridge, such as when an object is beneath the carpet, the carpet is otherwise warped or wrinkled or the floor beneath the carpet is otherwise not flat, the blade segments 135*s* engaging the ridged section of the floor surface move against the bias of the springs 157 in the blade holders 133 toward their retracted positions (FIG. 5A). Blade segments 135*s* not engaging the ridge in the floor surface remain in their extended position pressed down against the floor surface to reduce the size of any air gaps between the floor surface and the blade 135. Once the recovery tool 101 moves past the ridged portion of the floor surface, the springs 157 force the retracted blade segments 135*s* back toward their extended position. The independent movement of the blade segments 135*s* relative to the tool body and to one another ensures that the blade 135 remains substantially in engagement with the floor surface along the length of the blade as the recovery tool 101 is moved over contours in the floor surface.

Figure 7:
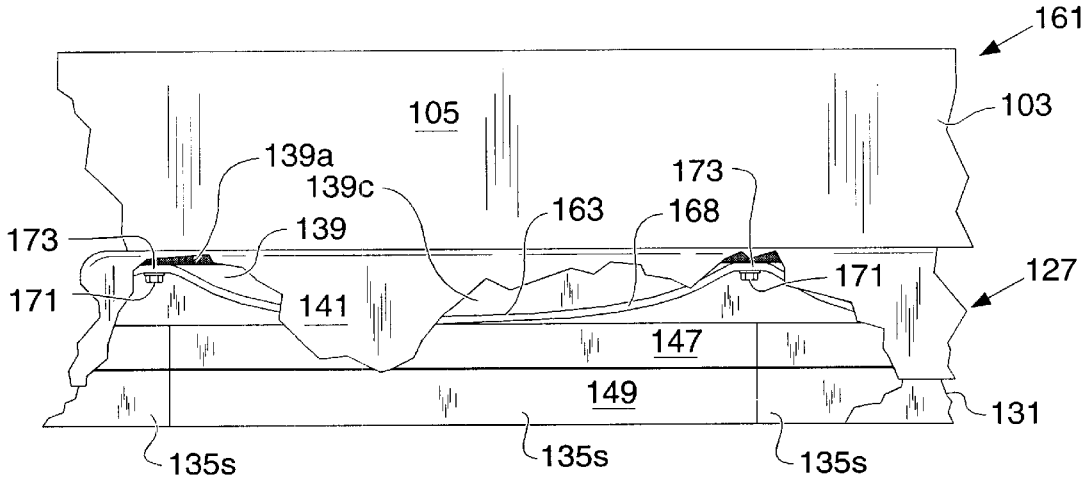
FIG. 7 is a fragmentary, front elevation and partial section with a portion broken away to reveal internal construction of another embodiment of the recovery tool of the present invention.

Referring now to FIG. 7, another embodiment of a recovery tool 161 of the present invention is shown. A leaf spring 163 (broadly, a spring member) is secured to the top wall 139*a* of each channel member 139 on the inside of the member in a position in which the spring is in biasing engagement with the top of respective blade segments 135*s* in the channel to bias the blade segments toward their extended positions. In the illustrated embodiment, a unitary strip 168 of resilient, metallic material extends generally the full length of the blade assembly 127 and engages each of the blade segments 135*s*. The leaf spring 163 is mounted in the blade holder 133 above the blade segments 135*s* by a series of posts 171 extending down from the top wall 139*a* of the channel member 139 through holes 173 in the spring spaced at intervals generally corresponding to the length of the blade segments. The portions of the springs 163 between the posts 171 curve downward for resilient engagement with the respective blade segments 135*s* to urge the segments toward their extended positions. It is also contemplated that individual leaf springs (not shown), each individually mounted on the blade holder 133 above a respective blade segment 135*s*, may be used instead of a unitary strip 168 without departing from the scope of this invention.

In another embodiment shown in FIG. 8, the blade holder 133 is substantially the same as the previous embodiments, except that the holder 133 comprises a tubular channel member 175 of unitary construction (e.g., without a separate cover 141 of the embodiment of FIGS. 3–6). To assemble this embodiment, the blade segments 135*s* are inserted through an open end of each channel member 175. End caps (not shown) are removably fitted on the open ends of the blade holder 133 to retain the blade segments 135*s* within the blade holder. Should one or more blade segments 135*s* become damaged or worn from use, removal of the end caps permits replacement of the blade segments.

In view of the above, it will be seen that the several objects of the invention are achieved and other advantageous results attained. The provision of multiple blade segments 135*s*, each capable of independent movement relative to the tool body 103 and relative to other segments, allows the blade segments to conform to the contours of the floor surface being cleaned. Biasing the individual blade segments 135*s* down against the floor surface promotes sealing of the vacuum in the suction chamber 111 of the tool body. This reduces the risk of air gaps forming between the blade 135 and the floor surface being cleaned, thereby maintaining the strength of the vacuum and promoting extraction of dirty solution 57 from the floor surface even as the recovery tool 79 passes over uneven sections of the floor surface. By increasing the amount of dirty solution 57 suctioned from the floor surface, the surface is less likely to become resoiled, since little residual fluid remains on the floor surface to attract dirt.

When introducing elements of the present invention or the preferred embodiment(s) thereof, the articles "a," "an," "the," and "said" are intended to mean that there are one or more of the elements. The terms "comprising," "including," and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A recovery tool for use in a floor cleaning machine of the type including a dispensing system configured for dispensing a liquid cleaning solution onto a floor surface to facilitate the removal of dirt from the floor surface and a recovery system configured for recovering cleaning solution and dirt from the floor surface thereby leaving a cleaned floor surface, the recovery system including a source of vacuum and a recovery tool in fluid communication with the source of vacuum for engaging the floor surface and suctioning cleaning solution and dirt into the recovery system, said recovery tool comprising;

a recovery tool body movable over the floor surface, said tool body including an interior suction chamber in fluid communication with the source of vacuum, and at least one elongate blade assembly secured to the tool body, said blade assembly comprising a resiliently mounted blade engageable with the floor surface to provide a seal between the blade and the floor surface, so that the source of vacuum suctions cleaning solution and dirt from the floor surface, the blade being substantially rigid to inhibit deformation of the blade during operation of the floor cleaning machine and being movable relative to the tool body such that the blade remains substantially in engagement with the floor surface along the length of the blade as the recovery tool is moved over contours in the floor surface.

2. A recovery tool including a first blade assembly for use in a floor cleaning machine of the type including a dispensing system configured for dispensing a liquid cleaning solution onto a floor surface to facilitate the removal of dirt from the floor surface and a recovery system configured for recovering cleaning solution and dirt from the floor surface thereby leaving a cleaned floor surface, the recovery system including a source of vacuum and a recovery tool in fluid communication with the source of vacuum for engaging the floor surface and suctioning cleaning solution and dirt into the recovery system, said recovery tool comprising;

a recovery tool body movable over the floor surface, said tool body including an interior suction chamber in fluid communication with the source of vacuum,.and at least one elongate blade assembly secured to the tool body, said first blade assembly comprising a resiliently mounted blade engageable with the floor surface to provide a seal between the blade and the floor surface, so that the source of vacuum suctions cleaning solution and dirt from the floor surface, the blade being substantially rigid to inhibit deformation of the blade during operation of the floor cleaning machine and being movable relative to the tool body such that the blade remains substantially in engagement with the floor surface along the length of the blade as the recovery tool is moved over contours in the floor surface; and the recovery tool further comprising a second elongate blade assembly secured to the tool body in spaced, generally parallel relationship with the first blade assembly, said second blade assembly comprising a blade engageable with the floor surface to provide a seal between the blade and the floor surface, said blade of the second blade assembly being movable relative to the tool body and relative to the blade of the first blade assembly.

3. A recovery tool as set forth in claim 2 wherein each blade assembly comprises a blade holder on the tool body and wherein each blade comprises a plurality of blade segments independently, resiliently mounted in the blade holder for floating movement of the individual segments with respect to the tool body and with respect to each other, the segments being adapted to retain positive engagement down against the floor to reduce the size of any air gaps between the floor and the blades, thereby reducing vacuum losses due to uneven flooring and increasing the amount of cleaning water and dirt extracted from the floor.

4. A recovery tool as set forth in claim 3 wherein each blade segment is urged downward in the blade holder to an extended position to promote contact of the blade segments against the floor.

5. A recovery tool as set forth in claim 4 wherein each blade assembly further comprises at least one spring for biasing the blade segments downward.

6. A recovery tool as set forth in claim 5 wherein each blade assembly comprises a plurality of coil springs, each spring being arranged generally vertically within the blade holder such that a lower end of each spring presses down against a respective blade segment to bias the blade segment downward for positive engagement with the floor.

7. A recovery tool as set forth in claim 6 wherein the lower end of each coil spring is received within an indent in an upper portion of a respective blade segment to properly orient and hold the spring in proper position within the tool.

8. A recovery tool as set forth in claim 5 wherein said at least one spring comprises a unitary leaf spring attached to the blade holder and extending substantially the full length of the holder for biasing each blade segment downward.

9. A recovery tool as set forth in claim 4 wherein the ends of adjacent blade segments abut one another such that there are no significant gaps between the segments.

10. A recovery tool as set forth in claim 4 wherein the blade segments are formed from a hard, plastic material.

11. A recovery tool as set forth in claim 2 wherein the first and second blade assemblies constitute a leading blade assembly and a trailing blade assembly relative to the direction of movement of the cleaning machine across a floor, and wherein the leading blade assembly is angled from vertical in the direction of machine movement and the trailing blade assembly is oriented substantially vertical.

12. For use in a floor cleaning machine of the type including a dispensing system configured for dispensing a liquid cleaning solution onto a floor surface to facilitate the removal of dirt from the floor surface, a recovery system configured for recovering cleaning solution and dirt from the floor surface thereby leaving a cleaned floor surface, said recovery system comprising:

a recovery tool movable over the floor surface, the recovery tool comprising a body including an interior suction chamber in fluid communication with a source of vacuum, and at least one elongate blade assembly comprising a pair of elongate blades depending from the tool body in spaced, generally parallel relationship, said blades being engageable with the floor surface to provide a seal between the blades and the floor surface, whereby cleaning solution and dirt are sucked from the floor surface, and said blades being movable relative to the tool body and relative to each other to adapt to contours in the floor surface.

13. A recovery system as set forth in claim 12 wherein each blade assembly further comprises a plurality of blade segments independently, resiliently mounted in the blade holder for floating movement of the individual segments with respect to the body and each other further enabling the blades to conform to uneven flooring, the segments being adapted to retain positive engagement down against the floor to reduce the size of any air gaps between the floor and the blades, thereby reducing vacuum losses due to uneven flooring and increasing the amount of cleaning water and dirt extracted from the floor.

14. A recovery system as set forth in claim 13 wherein each blade segment is independently biased downward to increase the contact force of the segments against the floor.

15. A recovery system as set forth in claim 14 wherein each blade assembly further comprises a plurality of coil springs each arranged vertically within the tool body such that a lower end of each spring presses downward against a respective blade segment to bias the segment downward for positive engagement with the floor.

16. A recovery system as set forth in claim 14 wherein said at least one spring comprises a unitary leaf spring attached to the blade holder and extending substantially the full length of the holder for biasing each blade segment downward.

17. A recovery system as set forth in claim 13 wherein the ends of adjacent blade segments abut one another such that there are no gaps between the segments.

18. A recovery system as set forth in claim 13 wherein the blade segments are formed from a hard, plastic material.

19. For use in a floor cleaning machine of the type including a dispensing system configured for dispensing a liquid cleaning solution onto a floor surface to facilitate the removal of dirt from the floor surface, a recovery system configured for recovering cleaning solution and dirt from the floor surface thereby leaving a cleaned floor surface, said recovery system comprising:

a recovery tool movable over the floor surface, the recovery tool comprising a body including an interior suction chamber in fluid communication with a source of vacuum and at least one blade secured to the tool body and depending therefrom for engagement with the floor surface to provide fluid communication between the suction chamber and the floor surface whereby cleaning solution and dirt are suctioned from the floor surface, the blade comprising a plurality of blade segments independently, resiliently mounted on the tool for floating movement of the individual segments with respect to the body and each other further enabling the segments to conform to uneven flooring, the segments being adapted to retain positive engagement down against the floor to reduce the size of any air gaps between the floor and the blades, thereby reducing vacuum losses due to uneven flooring and increasing the amount of cleaning water and dirt extracted from the floor.

20. In a cleaning machine comprising a main housing, at least one spray nozzle mounted on the main housing for spraying a cleaning solution onto a floor surface, a brush housing mounted on the main housing, said brush housing including at least one scrub brush for agitating a floor surface, and a recovery tool mounted on the main housing for vacuuming the used cleaning solution from the floor surface, wherein the improvement is an improved recovery tool comprising:

a recovery tool body tool movable over the floor surface, said tool body including an interior suction chamber in fluid communication with a source of vacuum and at least one elongate blade assembly secured to the tool body, said blade assembly comprising a resiliently mounted blade engageable with the floor surface to provide a seal between the blade and the floor surface, so that the source of vacuum suctions cleaning solution and dirt from the floor surface, the blade being substantially rigid to inhibit deformation of the blade during operation of the floor cleaning machine and being movable relative to the tool body such that the blade remains substantially in engagement with the floor surface along the length of the blade as the recovery tool is moved over contours in the floor surface.

* * * * *

UNITED STATES PATENT AND TRADEMARK OFFICE

CERTIFICATE OF CORRECTION

PATENT NO. : 6,591,448 B1
DATED : July 15, 2003
INVENTOR(S) : William R. Eklund

It is certified that error appears in the above-identified patent and that said Letters Patent is hereby corrected as shown below:

Column 5,
Line 38, delete "11" and replace with -- 111 --.

Signed and Sealed this

Twenty-eighth Day of October, 2003

JAMES E. ROGAN
*Director of the United States Patent and Trademark Office*